US010712692B2

(12) United States Patent
Kurata et al.

(10) Patent No.: US 10,712,692 B2
(45) Date of Patent: Jul. 14, 2020

(54) IMAGE FORMING APPARATUS HAVING SHEET LOOP CONTROL

(71) Applicant: CANON KABUSHIKI KAISHA, Tokyo (JP)

(72) Inventors: Munehito Kurata, Suntou-gun (JP); Shinji Hashiguchi, Hiratsuka (JP); Satoshi Murasaki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/295,237

(22) Filed: Mar. 7, 2019

(65) Prior Publication Data

US 2019/0302659 A1 Oct. 3, 2019

(30) Foreign Application Priority Data

Mar. 30, 2018 (JP) ..... 2018-070177

(51) Int. Cl.
*G03G 15/20* (2006.01)
*G03G 15/00* (2006.01)

(52) U.S. Cl.
CPC ..... *G03G 15/2028* (2013.01); *G03G 15/6576* (2013.01)

(58) Field of Classification Search
CPC ..... G03G 15/2028; G03G 15/6576
USPC ..... 399/68
See application file for complete search history.

(56) References Cited

U.S. PATENT DOCUMENTS

| | | | | |
|---|---|---|---|---|
| 6,920,293 | B2 | 7/2005 | Izawa et al. | |
| 8,326,169 | B2 | 12/2012 | Kurata et al. | |
| 8,335,448 | B2 * | 12/2012 | Nakajima | G03G 15/657 399/68 |
| 8,600,285 | B2 * | 12/2013 | Makinodan | G03G 15/2064 399/320 |
| 8,626,051 | B2 | 1/2014 | Kasuga et al. | |
| 9,261,844 | B2 * | 2/2016 | Honda | G03G 15/6529 |
| 2011/0150549 | A1 | 6/2011 | Imaizumi et al. | |

FOREIGN PATENT DOCUMENTS

| | | | |
|---|---|---|---|
| JP | 2001-106380 | A | 4/2001 |
| JP | 2009-113929 | A | 5/2009 |
| JP | 2010-253726 | A | 11/2010 |
| JP | 2012-051671 | A | 3/2012 |

* cited by examiner

*Primary Examiner* — Walter L Lindsay, Jr.
*Assistant Examiner* — Arlene Heredia
(74) *Attorney, Agent, or Firm* — Venable LLP

(57) ABSTRACT

An image forming apparatus includes a fixing unit to fix a toner image which has been transferred onto a sheet by a transfer portion, a loop detector to detect an amount of a loop formed on the sheet at a position between the transfer portion and the fixing unit, and a controller to control a sheet conveyance speed of the fixing unit based on a detection result of the loop detector and control a rotational speed of rotary members to convey the sheet based on an area ratio which is a ratio of an area in which the toner image is formed by the transfer portion within a predetermined region set on a printing surface of the sheet onto which the toner image is transferred. The predetermined region is located at a position distant from a leading edge of the sheet more than a distance between the transfer portion and the fixing unit in the sheet conveyance direction.

11 Claims, 7 Drawing Sheets

IMAGE FORMING APPARATUS HAVING SHEET LOOP CONTROL

BACKGROUND OF THE INVENTION

Field of the Invention

The present invention relates to an image forming apparatus configured to form an image on a sheet.

Description of the Related Art

In general, an image forming apparatus such as an electrophotographic printer is provided with a fixing unit configured to fix a toner image transferred onto a sheet by heat and pressure by means of a pressure roller and a fixing roller. The pressure roller is a rotary member having an outer circumferential surface constituted of an elastic member and may thermally expand due to an increase of temperature. In a case where the pressure roller thermally expands, a speed on the outer circumferential surface of the pressure roller, i.e., a sheet conveyance speed, fluctuates before and after the thermal expansion even if the pressure roller is rotationally driven at a constant angular velocity by a motor.

In view of preventing pulling of the sheet otherwise occurring between a transfer portion and the fixing unit, Japanese Patent Laid-open No. 2001-106380 discloses a technology of controlling a rotational speed of the pressure roller such that an amount of deflection (referred to as a "loop amount" hereinafter) of the sheet between the transfer portion and the fixing unit falls within a predetermined range. The technology of controlling the rotational speed of the pressure roller such that the loop amount falls within the predetermined range will be referred to as a loop control hereinafter. The rotational speed of the pressure roller is controlled by the loop control such that the loop amount of the sheet is constant. In other words, a sheet conveyance speed of the fixing unit can be controlled to be approximately equal with a process speed of the image forming apparatus which is a sheet conveyance speed of the transfer portion by the loop control. It is possible to convey the sheet stably without causing a difference between the sheet conveyance speed of the transfer portion and that of the fixing unit by controlling the sheet conveyance speed of the fixing unit approximately at the equal speed of the sheet conveyance speed of the transfer portion.

The variation of the sheet conveyance speed may occur in the image forming apparatus, besides the case caused by the thermal expansion of the pressure roller, also in a case where a frictional force varies between the sheet and a transfer member due to an image to be printed on the sheet and to a condition of a sheet surface. It is because there may be a case where a slip occurs between the sheet and the transfer member when the frictional force varies between the sheet and the transfer member. If the slip occurs between the sheet and the transfer member, the sheet conveyance speed at the transfer portion drops. If the sheet conveyance speed at the transfer portion drops, the image forming apparatus disclosed in Japanese Patent Laid-open No. 2001-106380 performs the loop control to control the sheet conveyance speed at the fixing portion such that it is approximately equalized with the dropped sheet conveyance speed at the transfer portion.

However, the image forming apparatus disclosed in Japanese Patent Laid-open No. 2001-106380 does not control a sheet conveyance speed at a rotary member pair disposed downstream in a sheet conveyance direction (referred to as a "downstream rotary member pair" hereinafter) with respect to the sheet conveyance speed of the fixing portion. Due to that, if a slip occurs between the sheet and the transfer member, there is a possibility that the downstream rotary member pair strongly pulls the sheet discharged out of the fixing portion, thus causing image defects.

SUMMARY OF THE INVENTION

According to one aspect of the present invention, an image forming apparatus includes an image bearing member configured to bear a toner image, a transfer portion configured to transfer the toner image borne on the image bearing member onto a sheet, a fixing portion configured to fix the toner image which has been transferred onto the sheet by the transfer portion to the sheet, a loop detecting portion configured to detect an amount of a loop formed on the sheet at a position between the transfer portion and the fixing portion, a rotary member pair disposed downstream in a sheet conveyance direction of the fixing portion and configured to convey the sheet, and a control portion configured to control a sheet conveyance speed of the fixing portion based on a detection result of the loop detecting portion and control a rotational speed of the rotary member pair based on an area ratio which is a ratio of an area in which the toner image is formed by the transfer portion within a predetermined region set on a printing surface of the sheet onto which the toner image is transferred.

Further features of the present invention will become apparent from the following description of exemplary embodiments with reference to the attached drawings.

DESCRIPTION OF THE EMBODIMENTS

First Embodiment

Entire Configuration

Figure 1:
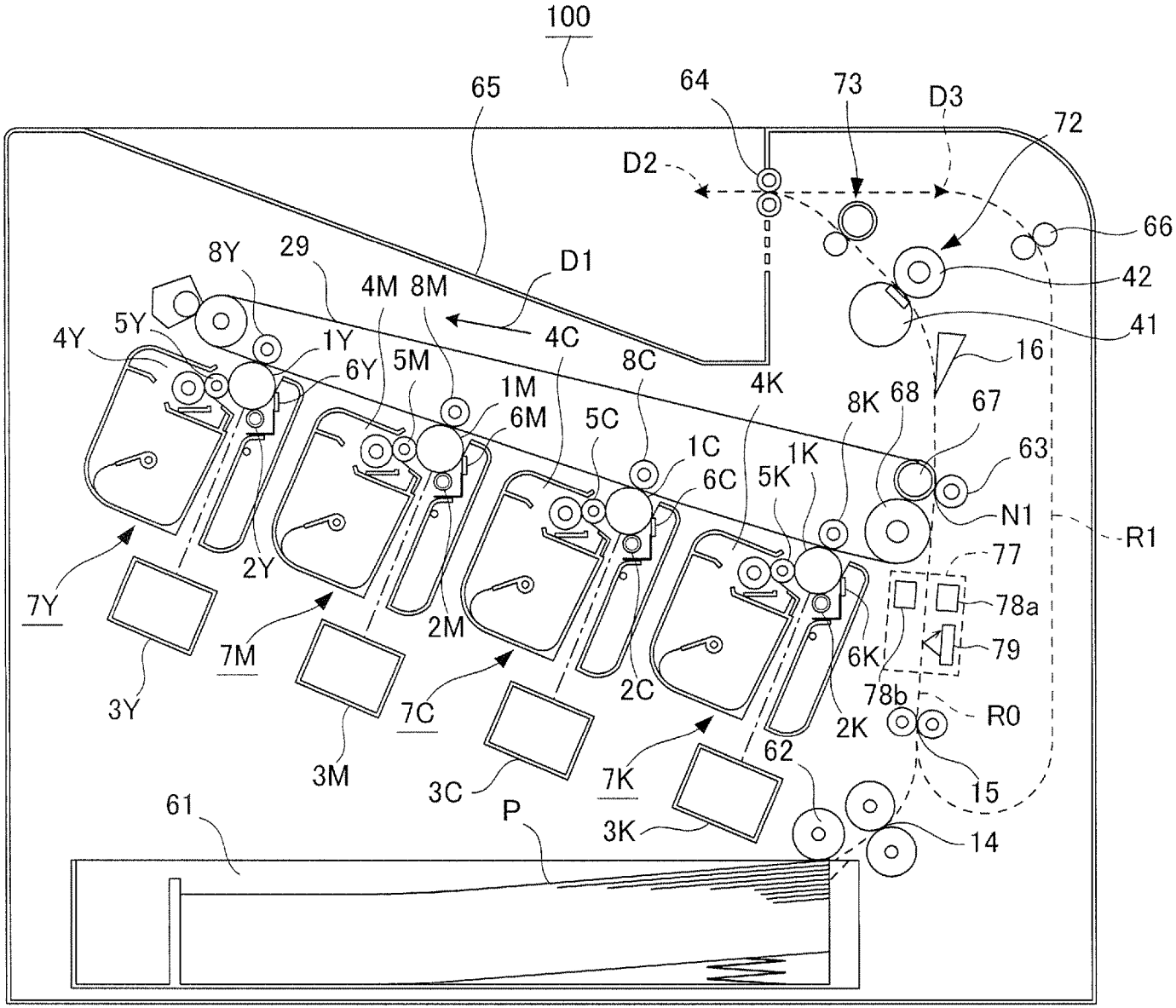
FIG. 1 is a schematic view illustrating an entire configuration of an image forming apparatus of a first embodiment.

An entire configuration of an image forming apparatus of a first embodiment will be described. A printer 100 illustrated in FIG. 1 is one example of the image forming apparatus of the present embodiment and is an electrophotographic color laser beam printer including a plurality of photosensitive drums 1. The printer 100 serving as the image forming apparatus mainly includes image forming stations 7Y, 7M, 7*c* and 7K, an intermediate transfer belt 29, a secondary transfer roller 63, a fixing unit 72 and a curling correcting unit (referred to as a "de-curling unit" hereinafter) 73. Here, the image forming stations 7Y, 7M, 7*c* and 7K correspond to respective colors of yellow (Y), magenta (M), cyan (C) and black (K). The following description will be made by using the subscripts Y, M, C and K denoting the respective colors while omitting names of the colors unless the respective colors need to be specifically distinguished.

Each of the image forming stations 7 corresponding to the respective colors of yellow (Y), magenta (M), cyan (C) and black (K) includes a photosensitive drum 1, a charging unit 2, a developing unit 4, a cleaning blade 6 and a primary transfer roller 8. In the image forming station 7Y for example, the charging unit 2Y charges a surface of the photosensitive drum 1Y homogeneously. An electrostatic latent image is then formed on the surface of the photosensitive drum 1Y by a laser beam based on image information irradiated to the surface of the photosensitive drum 1Y by a laser scanner 3Y. The developing unit 4Y includes a developing roller 5Y forming a toner image by applying toner to the electrostatic latent image formed on the photosensitive drum 1Y. The primary transfer roller 8Y primarily transfers the toner image formed on the photosensitive drum 1Y onto the intermediate transfer belt 29 serving as an image bearing member. Note that an arrow of solid line D1 indicates a rotation direction of the intermediate transfer belt 29. The intermediate transfer belt 29 is rotated by a driving roller 68 that rotates at a constant speed by being rotationally driven by a main motor not illustrated in FIG. 1. That is, the intermediate transfer belt 29 conveys the toner image while rotating and bearing the toner image on an outer circumferential surface thereof. The cleaning blade 6Y removes toner left on the photosensitive drum 1Y without being primarily transferred.

Note that the image forming stations 7M, 7*c* and 7K, other than the image forming station 7Y, have the same configuration with the image forming station 7Y. Therefore, the description regarding the image forming stations 7M, 7*c* and 7K will be same with that of the image forming station 7Y described above just by changing the subscripts from Y to M, C and K.

Thus, the toner images formed on the surfaces of the respective photosensitive drums 1Y, 1M, 1C and 1K are primarily transferred onto the intermediate transfer belt 29 sequentially while matching with disposition of the image forming stations 7 from upstream in a rotation moving direction of the intermediate transfer belt 29. In the printer 100 illustrated in FIG. 1, the toner images formed on the surfaces of the respective photosensitive drums 1Y, 1M, 1C and 1K are primarily transferred onto the intermediate transfer belt 29 in order of yellow (Y), magenta (M), cyan (C) and black (K).

Still further, as illustrated in FIG. 1, a cassette 61 is drawably stored in a lower part of the printer 100. Sheets P such as sheets of paper are stacked and stored in the cassette 61. The sheet P is delivered out of the cassette 61 by a pickup roller 62, is separated one by one by a separation roller pair 14 and is fed to a registration roller pair 15. The sheet P fed to the registration roller pair 15 is conveyed through a sheet conveyance path R0 in a sheet conveyance direction D2.

The sheet P fed to the registration roller pair 15 is conveyed along the sheet conveyance path R0 sequentially through a secondary transfer nip portion N1 serving as a transfer portion, a fixing unit 72 serving as a fixing portion, a de-curling unit 73 serving as a rotary member pair and a discharge roller pair 64. The toner image on the intermediate transfer belt 29 is secondarily transferred onto the sheet P at the secondary transfer nip portion N1 serving as the transfer portion composed of a counter roller 67 and the secondary transfer roller 63. Secondary transfer residual toner left on the surface of the intermediate transfer belt 29 without being transferred onto the sheet P at the secondary transfer nip portion N1 is removed and collected by a belt cleaning unit not illustrated.

The sheet P onto which the toner image has been secondarily transferred is conveyed to the fixing unit 72 from the secondary transfer nip portion N1. The sheet P conveyed to the fixing unit 72 is pressurized and heated to fix the secondarily transferred toner image onto the sheet P. The sheet P onto which the toner image has been fixed is conveyed from the fixing unit 72 to the de-curling unit 73 serving as the rotary member pair. The de-curling unit 73 corrects a curl of the sheet P conveyed thereto. The sheet P whose curl has been corrected is conveyed from the de-curling unit 73 to the discharge roller pair 64 and is discharged out by the discharge roller pair 64 to a sheet stacking portion 65.

Note that a loop detecting portion 16 is provided between the secondary transfer nip portion N1 and the fixing unit 72 along the sheet conveyance path R0. In the printer 100, a sheet conveyance speed at the fixing unit 72 is controlled based on whether a loop amount of the sheet P detected by the loop detecting portion 16 is within an adequate range. Note that the control of the sheet conveyance speed will be detained later.

In a case of forming images on both surfaces of the sheet P, the discharge roller pair 64 rotates inversely to convey the sheet P in which the image has been printed on a first surface thereof in a direction of a broken arrow D3, which is a direction inverse to the sheet conveyance direction D2, to guide the sheet P to an inverse conveyance path R1. The sheet P which has conveyed to the inverse conveyance path R1 is conveyed again to the registration roller pair 15 by a conveyance roller pair 66 and others. The sheet P conveyed to the registration roller pair 15 through the inverse conveyance path R1 is conveyed to the secondary transfer nip portion N1 in a condition in which a non-printed second surface on a side opposite from the first surface faces the intermediate transfer belt 29. After that, another image is formed onto the second surface in the same manner with the image forming process of the first surface of the sheet P. More specifically, a toner image is secondarily transferred onto the second surface of the sheet P at the secondary transfer nip portion N1. Next, the toner image transferred onto the second surface of the sheet P is fixed at the fixing unit 72. Next, a curl of the sheet P is corrected by the de-curling unit 73. Then, the sheet P whose curl has been corrected is discharged by the discharge roller pair 64 to the sheet stacking portion 65.

A media sensor 77 that is configured to be able to detect sheet attributes such as surface nature and grammage of the sheet P conveyed through the sheet conveyance path R0 is provided between the registration roller pair 15 and the secondary transfer nip portion N1 along the sheet conveyance path R0. Here, the grammage is a mass per unit area of the sheet P and is expressed by [g/m$^2$]. The media sensor 77 as illustrated in FIG. 1 includes an ultrasonic sensor detecting the grammage of the sheet P. The ultrasonic sensor includes a transmitting portion 78*a* transmitting ultrasonic and a receiving portion 78*b* receiving the ultrasonic. The receiving portion 78*b* receives the ultrasonic transmitted from the transmitting portion 78*a* and attenuated through the sheet P. The ultrasonic sensor detects the grammage of the sheet P based on the ultrasonic received by the receiving portion 78*b*. The media sensor 77 also includes an optical sensor 79 detecting the surface nature of the sheet P. The optical sensor 79 receives reflection light of light irradiated to the sheet P and detects the surface nature of the sheet P based on the received reflection light.

Fixing Unit

Figure 2:
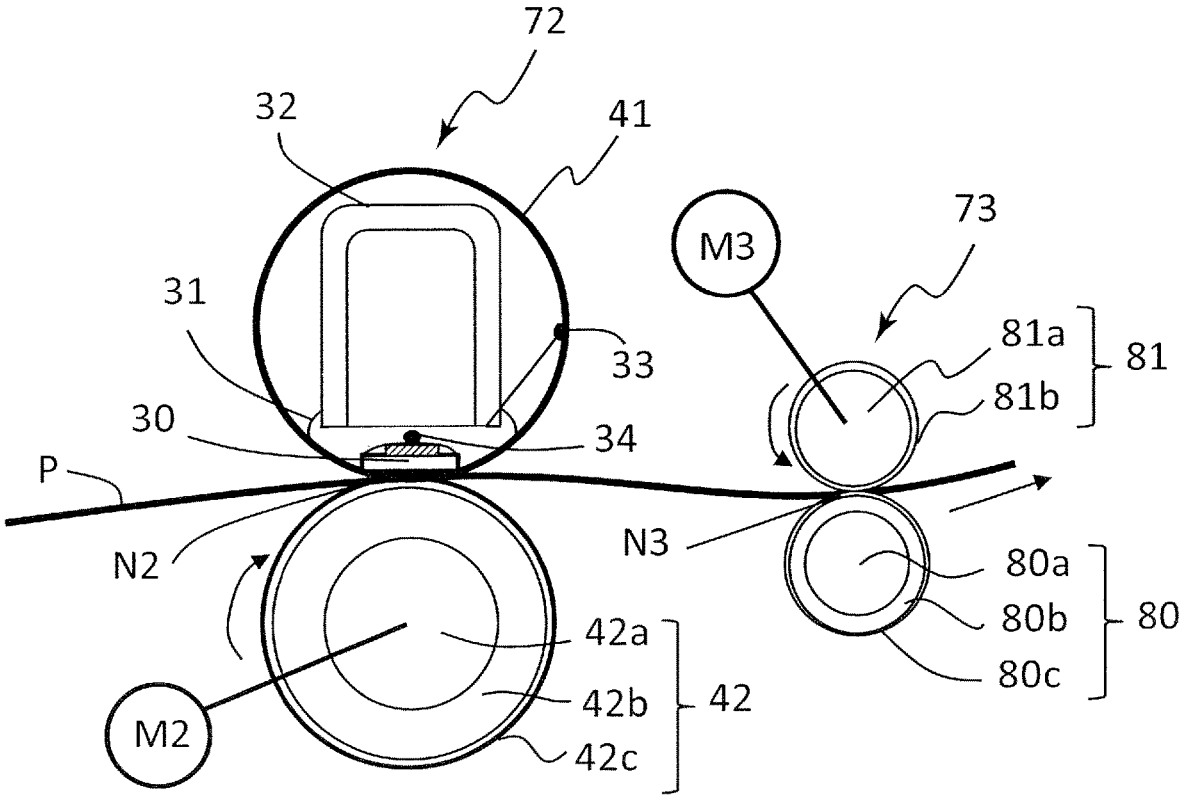
FIG. 2 is a section view illustrating a fixing portion and a rotary member pair.

The fixing unit 72 as illustrated in FIG. 2 includes a pressure roller 42, a fixing sleeve 41 which is a flexible member and a heater 30 such as a halogen heater. The fixing unit 72 is also provided with a sleeve thermistor 33 inscribed inside of the fixing sleeve 41 and a heater thermistor 34 abutting with the heater 30. The sleeve thermistor 33 detects temperature of the fixing sleeve 41 and the heater thermistor 34 detects temperature of the heater 30.

The pressure roller 42 of the fixing unit 72 is constituted of a core shaft portion 42*a*, at least one layer or more of a heat-resistant elastic layer 42*b* provided around the core shaft portion 42*a* and a release layer 42*c* provided around the heat-resistant elastic layer 42*b*. The core shaft portion 42*a* is made of a metallic material such as steel. The heat-resistant elastic layer 42*b* is made of an ordinary heat-resistant rubber elastic material such as silicon rubber and fluoro rubber. The release layer 42*c* is formed of a single or blended item of fluoroplastics or of a tube of the single or blended item of fluoroplastics coated around the heat-resistant elastic layer 42*b*. The fluoroplastics applicable to the release layer 42*c* may be PFA, PTFE (polytetrafluoroethylene) and FEP (tetrafluoroethylene-hexafluoropropylene co-polymer) for example.

Figure 3:
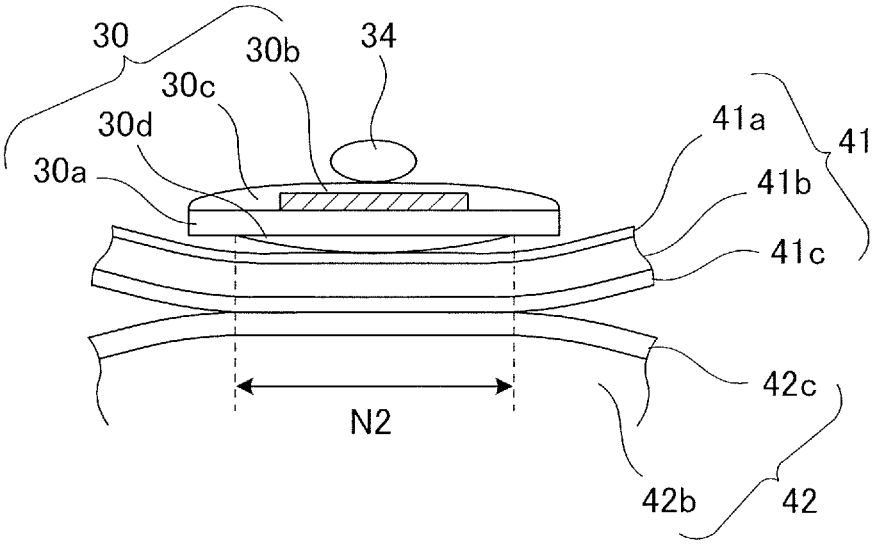
FIG. 3 is an enlarged view illustrating a fixing nip portion.

As illustrated in FIG. 3, the fixing sleeve 41 of the fixing unit 72 is constituted of an endlessly formed base layer 41*a*, an elastic layer 41*b* formed around the base layer 41*a* and a releasing layer 41*c* formed around the elastic layer 41*b*. A resin material such as polyimide, a metallic material such as stainless steel (SUS), aluminum (Al), nickel (N1), copper (Cu) and zinc (Zn) or an alloy member of those materials for example may be used for the base layer 41*a*. The elastic layer 41*b* is constituted of a material having high heat conductivity. The releasing layer 41*c* is constituted of such material as fluoroplastics such as PTFE and PFA (tetrafluoroethylene-perfluoro alkyl vinyl ether co-polymer) and silicon resin for example. The releasing layer 41*c* prevents an offset phenomenon that otherwise occurs in a case where toner adhered once on the surface of the fixing sleeve 41 moves again to a sheet P.

As illustrated in FIG. 3, the heater 30 includes a substrate 30*a*, a resistance heating element layer 30*b*, an insulating glass layer 30*c* and a sliding layer 30*d*. The substrate 30*a* is a high heat conductive insulating substrate which is narrow and long in a longitudinal direction which is in parallel with an axial direction of the pressure roller 42, i.e., in a vertical direction with respect to the surface of FIG. 3, and which is constituted of ceramics such as aluminum nitride (AlN) and alumina ($Al_2O_3$). The resistance heating element layer 30*b* is a layer of a resistance heating element mainly composed of an AgPd alloy, a NiSn alloy, a $RuO_2$ alloy or the like and is energized from both ends in the longitudinal direction by a power supply not illustrated. The resistance heating element layer 30*b* generates heat by being energized from the both ends. The insulating glass layer 30*c* coats over the resistance heating element layer 30*b*. Besides assuring insulation from an external conductive member, the insulating glass layer 30*c* has functions of corrosion resistance of preventing a resistance value of the resistance heating element layer 30*b* from varying due to oxidation and the like and of preventing mechanical damage of the resistance heating element layer 30*b*. The sliding layer 30*d* is what is composed of imide resin such as PI (polyimide) and PAI (polyamide imide) and has functions excellent in heat resistance, lubrication and wear resistance. The sliding layer 30*d* is provided on the substrate 30*a* on a surface sliding with an inner peripheral surface of the fixing sleeve 41 and smoothly slides with respect to the inner circumferential surface of the fixing sleeve 41.

As illustrated in FIG. 2, the pressure roller 42 is rotationally driven by a fixing motor M2 in the fixing unit 72 constructed as described above. Along with the rotation of the pressure roller 42, the fixing sleeve 41 is also frictionally driven by the surface of the pressure roller 42. That is, the fixing sleeve 41 rotates following the pressure roller 42. The fixing nip portion N2 is defined in the fixing unit 72 by the pressure roller 42 pressed against the fixing sleeve 41. The temperature of the heater 30 is controlled at a predetermine temperature based on temperature information detected by the sleeve thermistor 33 and the heater thermistor 34. The non-fixed toner image on the sheet P is fixed onto the sheet P by heat and pressure applied to the toner image by being nipped and conveyed through the fixing nip portion N2.

De-Curling Device

As illustrated in FIG. 2, the de-curling unit 73 includes a de-curling roller pair of a de-curling roller 80 and a de-curling counter roller 81. The de-curling counter roller 81 is in pressure contact with the de-curling roller 80, and a nip portion N3 is defined by the de-curling roller 80 and the de-curling counter roller 81 in the de-curling unit 73. The de-curling roller 80 includes a core shaft portion 80*a*, an elastic layer 80*b* provided around the core shaft portion 80*a* and a release layer 80*c* provided around the elastic layer 80*b*. The de-curling counter roller 81 also includes a core shaft portion 81*a* and a release layer 81*b* provided around the core shaft portion 81*a*.

In the de-curling unit 73 constructed as described above, a de-curling motor M3 applies a rotational driving force to the de-curling counter roller 81 to rotationally drive the de-curling counter roller 81. The de-curling roller 80 is pressurized from the de-curling counter roller 81 and is driven by the de-curling counter roller 81. That is, the de-curling roller 80 coated with the elastic layer 80*b* having low hardness is pressed by the de-curling counter roller 81 having no elastic layer and having high hardness, so that the de-curling nip portion N3 is defined in the de-curling unit 73 along an outer diameter of the de-curling counter roller 81. When the sheet P is conveyed from the fixing unit 72 to the de-curling unit 73, a curl which has been generated when the toner image has been fixed at the fixing nip portion N2 defined in the fixing unit 72 is corrected by the de-curling nip portion N3 defined in the de-curling unit 73.

Control of Sheet Conveyance Speed

Figure 4:
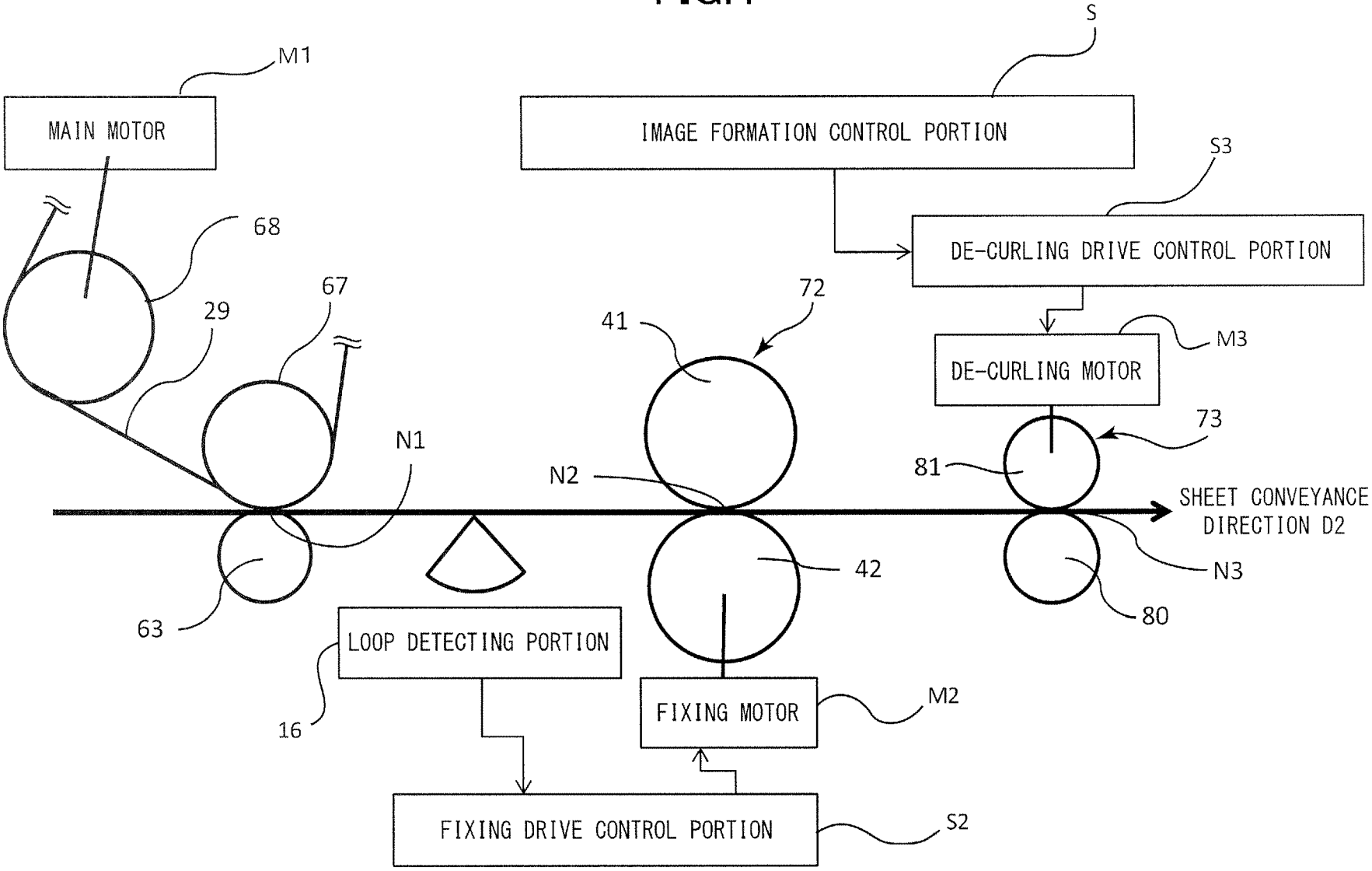
FIG. 4 illustrates a sheet conveyance control.

Next, the control of the sheet conveyance speed in the printer 100 will be described. As illustrated in FIG. 4, the printer 100 includes an image forming control portion S serving as a control portion, a fixing drive control portion S2 and a de-curling drive control portion S3. In the printer 100, the image forming control portion S controls an image forming process of forming an image onto the sheet P and instructs the de-curling drive control portion S3. The fixing drive control portion S2 makes a loop control by increasing/decreasing a rotational speed of the fixing motor M2. The de-curling drive control portion S3 adjusts the sheet conveyance speed at the de-curling unit 73 by increasing/decreasing the rotational speed of the de-curling motor M3. In the printer 100, the sheet P is conveyed in the sheet conveyance direction D2 and sequentially passes through the secondary transfer nip portion N1, the fixing nip portion N2 defined at the fixing unit 72 and the de-curling nip portion N3 defined at the de-curling unit 73.

The sheet conveyance speed at the secondary transfer nip portion N1 is controlled by controlling a rotational speed of the intermediate transfer belt 29. The intermediate transfer belt 29 is rotated by the driving roller 68 which is rotationally driven by a main motor M1. The secondary transfer roller 63 defining the secondary transfer nip portion N1 together with the counter roller 67 is driven by the intermediate transfer belt 29. The rotational speed of the intermediate transfer belt 29 is set to be coincident with a process speed of the image forming station 7 which is equal with a peripheral speed of the photosensitive drum 1 illustrated in FIG. 1 (referred simply as a "process speed" hereinafter). In other words, the sheet conveyance speed at the secondary transfer nip portion N1 is set to be coincident with the process speed described above.

The sheet conveyance speed at the fixing nip portion N2 is controlled by the fixing drive control portion S2 controlling the rotational speed of the pressure roller 42. The pressure roller 42 is rotationally driven by the fixing motor M2. The fixing sleeve 41 is driven by the pressure roller 42. The fixing drive control portion S2 controls the rotational speed of the fixing motor M2 based on a detection result of the loop detecting portion 16 and makes the loop control of adjusting a loop amount of the sheet P between the secondary transfer nip portion N1 and the fixing nip portion N2. The loop control of the fixing drive control portion S2 is made by controlling the rotational speed of the fixing motor M2 to adequately keep the loop amount between the secondary transfer nip portion N1 and the fixing nip portion N2 and to keep the sheet conveyance speed at the fixing nip portion N2 almost constant. In other words, the sheet conveyance speed at the fixing nip portion N2 is controlled by the fixing drive control portion S2 so as to be almost equalized with the sheet conveyance speed at the secondary transfer nip portion N1.

In FIG. 4, the sheet conveyance speed at the de-curling nip portion N3 where the sheet P passes through next to the fixing nip portion N2 is controlled by the de-curling drive control portion S3 controlling the rotational speed of the de-curling counter roller 81. The de-curling counter roller 81 is rotationally driven by the de-curling motor M3. The de-curling roller 80 is driven by the de-curling counter roller 81. The de-curling drive control portion S3 controls the sheet conveyance speed at the de-curling nip portion N3 by increasing/decreasing the rotational speed of the de-curling counter roller 81 based on printing image information transmitted from the image forming control portion S. Because a curled sheet P is conveyed between the fixing unit 72 and the de-curling unit 73, if the sheet P is loosened, the sheet P is inclined to be deformed further, thus generating conveyance failure such as a sheet jam. In view of suppressing the occurrence of such conveyance failure, the sheet conveyance speed at the de-curling nip portion N3 is often set to be large of a degree not excessively pulling the sheet P with respect to the sheet conveyance speed at the fixing nip portion N2. Then, the sheet conveyance speed at the de-curling nip portion N3 is set at a speed faster by around several % with respect to the sheet conveyance speed at the fixing unit that can be controlled almost equally with the process speed by the loop control, i.e., at a speed of the process speed+several % for example.

It is necessary to control the rotational speed of the fixing motor M2 by considering thermal expansion and thermal contraction of the pressure roller 42 in order for the fixing drive control portion S2 to control the sheet conveyance speed to be almost constant at the fixing nip portion N2. Specifically, in a case where an outer diameter of the pressure roller 42 is enlarged by high temperature, it is necessary for the fixing drive control portion S2 to delay the rotational speed of the fixing motor M2 because the loop amount of the sheet P between the secondary transfer nip portion N1 and the fixing nip portion N2 decreases. Meanwhile, in a case where the outer diameter of the pressure roller 42 is reduced by low temperature, it is necessary to fasten the rotational speed of the fixing motor M2 because the loop amount of the sheet P between the secondary transfer nip portion N1 and the fixing nip portion N2 increases. Here, the content of the loop control made by the fixing drive control portion S2 will be described more specifically with reference to FIGS. 5 and 6. Note that the reference numerals P0, P1 and P2 in FIGS. 5A and 5B indicate attitudes of the sheet P in a case where the loop amount of the sheet P between the secondary transfer nip portion N1 and the fixing nip portion N2 is normal, in a case where it is smaller than the normal case and in a case where it is larger than the normal case, respectively.

Figure 5A:
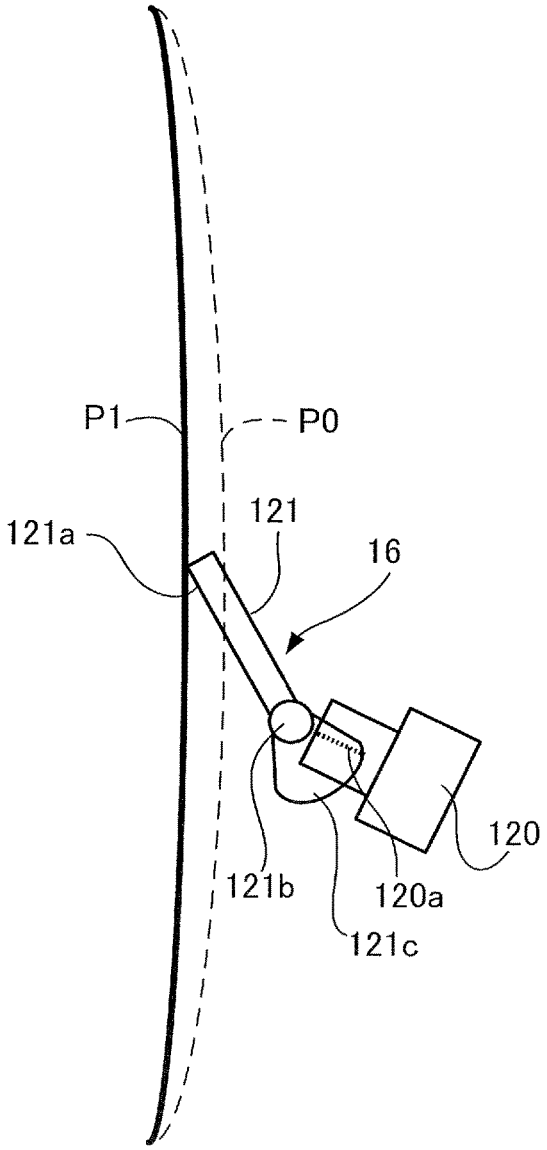
FIG. 5A is a schematic view illustrating a configuration of a loop detecting portion in a case where a loop sensor is "OFF".
Figure 5B:
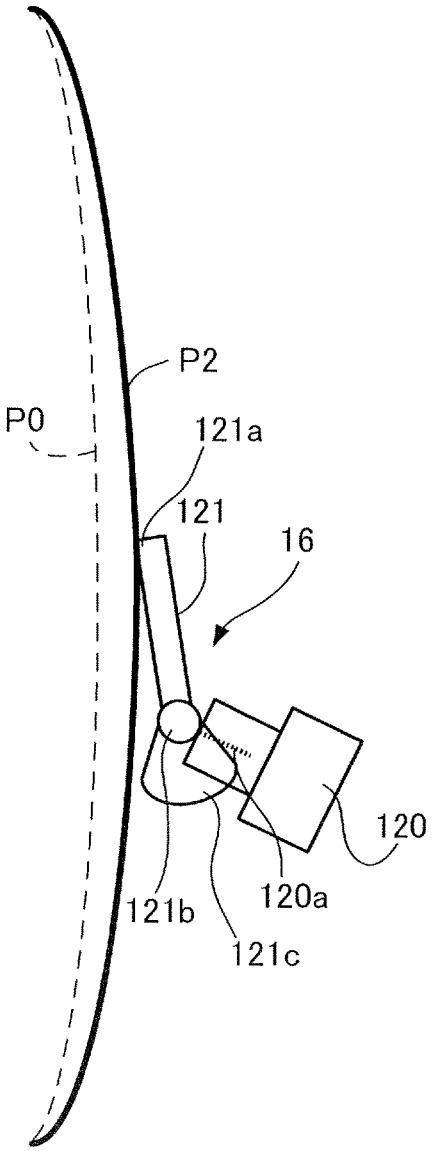
FIG. 5B is a schematic view illustrating the configuration of the loop detecting portion in a case where the loop sensor is "ON".

At first, the loop detecting portion 16 and an operation thereof will be described. As illustrated in FIGS. 5A and 5B, the loop detecting portion 16 includes a loop sensor 120 and a loop sensor flag 121. The loop sensor 120 is provided with a light emitting portion and a photo-sensing portion not illustrated and a slit 120*a* through which light emitted from the light emitting portion can pass. The loop sensor flag 121 includes a contact portion 121*a* being in contact with the sheet P, an axial portion 121*b* and a flag portion 121*c* capable of closing/opening the slit 120*a*. The loop sensor flag 121 pivots centering on the shaft portion 121*b* as the contact portion 121*a* slides while in contact with the sheet P, and the flag portion 121*c* also pivots along with the pivot of the loop sensor flag 121. An amount of pivot of the flag portion 121*c* is small in a case where a loop amount of the sheet P is small and is large in a case where the loop amount of the sheet P is large.

Figure 6A:
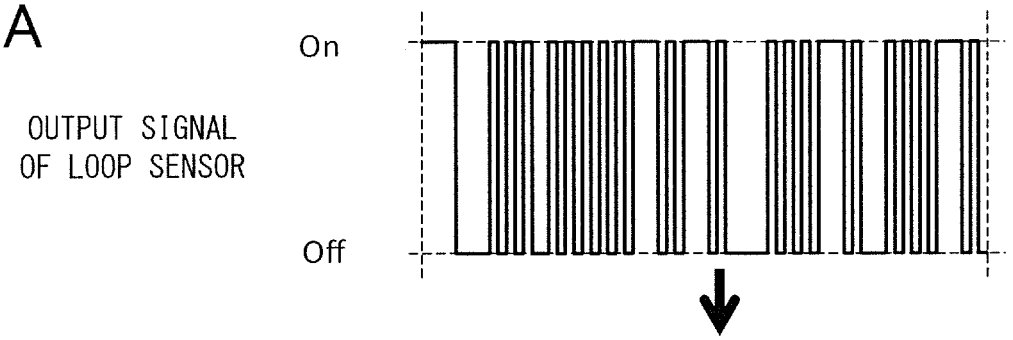
FIG. 6A illustrates an output signal of the loop sensor.

In a case where the loop amount of the sheet P is small and the amount of pivot of the flag portion 121*c* is small as illustrated in FIG. 5A, the photo-sensing portion does not receive the illumination light from the light emitting portion because the slit 120*a* is shaded by the flag portion 121*c*. Meanwhile, in a case where the loop amount of the sheet P is large and the amount of pivot of the flag portion 121*c* is large as illustrated in FIG. 5B, the photo-sensing portion receives the illumination light from the light emitting portion without being shaded by the flag portion 121*c* because the flag portion 121*c* is off from the slit 120*a*. The loop sensor 120 detects whether the loop amount of the sheet P falls within a tolerance by detecting whether the photo-sensing portion receives the light and outputs a signal indicating a detection result to the fixing drive control portion S2. The output signal of the loop sensor 120 indicating the detection result is either an ON signal whose signal output is located at a position of ON or an OFF signal whose signal output is located at a position of OFF as illustrated in FIG. 6A. For instance, in a case where the loop amount as illustrated in FIG. 5A is small and the photo-sensing portion does not receive the illumination light from the light emitting portion, the loop sensor 120 outputs the OFF signal to the fixing drive control portion S2. Meanwhile, in a case where the loop amount as illustrated in FIG. 5B is large and the photo-sensing portion receives the illumination light from the light emitting portion, the loop sensor 120 outputs the ON signal to the fixing drive control portion S2.

Figure 6B:
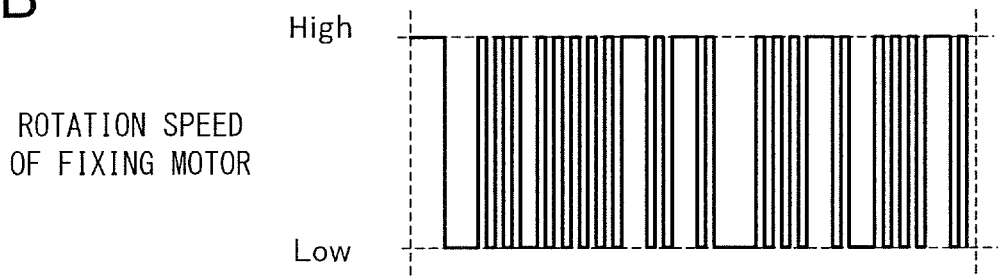
FIG. 6B illustrates a rotational speed of a fixing motor controlled by a fixing drive control portion.

Next, the control of the rotational speed of the fixing motor M2 made by the fixing drive control portion S2 will be described with reference to FIGS. 6A and 6B. The rotational speed of the fixing motor M2 indicated in FIG. 6B increases or decreases by changeover of two speeds of high speed by which the rotational speed becomes High and of low speed by which the rotational speed becomes Low as indicated in FIG. 6B. The changeover of the rotational speeds of the high and low speeds of the fixing motor M2 made by the fixing drive control portion S2 is made corresponding to the changeover of the ON and OFF signals of the output signal of the loop sensor 120 as indicated in FIG. 6A.

Specifically, at the timing when the loop sensor 120 outputs the OFF signal, i.e., in a condition as illustrated in FIG. 5A, the fixing drive control portion S2 controls the rotational speed of the fixing motor M2 to be low speed. That is, the rotational speed of the fixing motor M2 is controlled in a direction of increasing the loop amount of the sheet P. Meanwhile, at the timing when the loop sensor 120 outputs the ON signal, i.e., in a condition as illustrated in FIG. 5B, the fixing drive control portion S2 controls the rotational speed of the fixing motor M2 to be high speed. That is, the rotational speed of the fixing motor M2 is controlled in a direction of reducing the loop amount of the sheet P. The value of LOW indicated in FIG. 6A, i.e., the rotational speed on the low speed side of the fixing motor M2, is set such that the sheet conveyance speed falls under the process speed in a case where the outer diameter of the pressure roller 42 is presumably maximized. The value of High indicated in FIG. 6B, i.e., the rotational speed on the high speed side of the fixing motor M2 is set such that the sheet conveyance speed is more than the process speed in a case where the outer diameter of the pressure roller 42 is presumably minimized. Thus, the fixing drive control portion S2 adequately keeps the loop amount between the secondary transfer nip portion N1 and the fixing nip portion N2 by increasing or decreasing the rotational speed of the fixing motor M2 corresponding to the detection result of the loop detecting portion 16.

Thus, the fixing drive control portion S2 maintains the loop amount of the sheet P by controlling the sheet conveyance speed caused by the fixing nip portion N2 such that a sheet conveyance amount caused by the fixing nip portion N2 approaches to a sheet conveyance amount caused by the secondary transfer nip portion N1 after when a leading edge of the sheet P has reached the de-curling unit 73. Then, the sheet conveyance speed caused by the fixing nip portion N2 is controlled based on the detection result of the loop sensor 120. Note that although the optical loop sensor 120 has been used in the present embodiment, the present disclosure is not limited to that, and another sensor such as a switch and an ultrasonic sensor may be used.

There is a case where a slip occurs between the sheet P and the intermediate transfer belt 29 in such conveyance process of the sheet P. The slip between the sheet P and the intermediate transfer belt 29 occurs in a case where force acting in the secondary transfer nip portion N1 surpasses a frictional force between the intermediate transfer belt 29 and the sheet P. The force acting in the secondary transfer nip portion N1 is a force of moving the sheet P upstream in the sheet conveyance direction in the conveyance process of the sheet P. In the conveyance process of the sheet P, a certain loop is formed by the sheet P to make the loop control between the fixing nip portion N2 and the secondary transfer nip portion N1. In a case where the sheet P is nipped by both of the fixing nip portion N2 and the secondary transfer nip portion N1, a force of trying to eliminate a loop condition acts on the sheet P by own stiffness. As a result of the force acting to try to eliminate the loop condition, the force of moving the sheet P upstream in the sheet conveyance direction acts on the sheet P. Note that the force of trying to eliminate the loop by the stiffness of the sheet P acts also in the fixing nip portion N2. However, a nip pressure of the fixing nip portion N2 is about 30 kgf for example and is considerably large as compared to that of the secondary transfer nip portion N1. Accordingly, no slip is considered to happen at the fixing nip portion N2 even if the slip occurs previously at the secondary transfer nip portion N1.

Meanwhile, it is known that the frictional force between the intermediate transfer belt 29 and the sheet P is small in a region where a toner image is formed more than a region where no toner image is formed and is blanked. An area ratio of an area in which a toner image is formed on a printing surface by the secondary transfer nip portion N1 with respect to a predetermined region such as a whole printing surface set on the printing surface of the sheet P will be called as a "coverage rate" hereinafter. That is, in a case where no range in which a toner image is formed exists in the predetermined region on the printing surface, the coverage rate is zero %. Meanwhile, in a case where a toner image is formed in the whole predetermined region, the coverage rate is 100%. In terms of the coverage rate, the larger the coverage rate, the smaller the frictional force between the intermediate transfer belt 29 and the sheet P becomes, so that a slip is liable to occur between the sheet P and the intermediate transfer belt 29. It is also known that the smoother the surface nature of the sheet P itself, the smaller the frictional force between the intermediate transfer belt 29 and the sheet P becomes, so that a slip is liable to occur between the sheet P and the intermediate transfer belt 29 when the surface nature of the sheet P itself is smooth.

In a case where the slip occurs between the sheet P and the intermediate transfer belt 29 in the conveyance process of the sheet P, an actual sheet conveyance speed drops even if the sheet conveyance speed at the secondary transfer nip portion N1 is controlled to be constant. The fixing drive control portion S2 controls the rotational speed of the fixing motor M2 such that the loop amount of the sheet P becomes constant even if the speed of the sheet P at the secondary transfer nip portion N1 drops during a period in which the sheet P is nipped by both of the secondary transfer nip portion N1 and the fixing nip portion N2. In such a case, the fixing drive control portion S2 controls the sheet conveyance speed at the fixing nip portion N2 so as to be coincident with the actual sheet conveyance speed at the secondary transfer nip portion N1, i.e., the sheet conveyance speed after the drop. As a result, both of the actual sheet conveyance speeds at the secondary transfer nip portion N1 and the fixing nip portion N2 fall under the process speed.

As a result of the drop of the sheet conveyance speed at the fixing nip portion N2, the sheet conveyance speed at the de-curling nip portion N3 during a period in which the sheet P is nipped by both of the fixing nip portion N2 and the de-curling nip portion N3 becomes faster than the sheet conveyance speed at the fixing nip portion N2. That is, if the slip occurs between the sheet P and the intermediate transfer belt 29 in the conveyance process of the sheet P, the sheet P is strongly pulled by the de-curling nip portion N3 between the fixing nip portion N2 and the de-curling nip portion N3. The sheet P strongly pulled by the de-curling nip portion N3 between the fixing nip portion N2 and the de-curling nip portion N3 becomes wavy in a width direction when the sheet P is discharged out of the fixing nip portion N2. In a case where the sheet P becomes wavy in the width direction, the sheet P causes unevenness on the surface of the toner image after the fixation, thus causing unevenness in the gloss. That is, the sheet P causes a defective image. Then, in a case where the sheet conveyance speed drops at the fixing nip portion N2, the de-curling drive control portion S3 adjusts the sheet conveyance speed at the de-curling nip portion N3 by controlling the rotational speed of the de-curling motor M3.

Next, the control of the sheet conveyance speed at the de-curling unit 73 in the printer 100 will be described. In the present embodiment, the de-curling drive control portion S3 increases or decreases the sheet conveyance speed at the de-curling nip portion N3 by controlling the rotational speed of the de-curling motor M3 based on likelihood of occurrence of the slip between the sheet P and the intermediate transfer belt 29. The likelihood of occurrence of the slip between the sheet P and the intermediate transfer belt 29 is determined by magnitude of the frictional force generated between the sheet P and the intermediate transfer belt 29. Then, in the present embodiment, the de-curling drive control portion S3 adjusts the sheet conveyance speed at the de-curling unit 73 in plurality of stages, e.g., three stages, corresponding to the magnitude of the frictional force generated between the sheet P and the intermediate transfer belt 29. In a case where the frictional force generated between the sheet P and the intermediate transfer belt 29 is small, the de-curling drive control portion S3 delays the sheet conveyance speed at the de-curling nip portion N3 and in a case where the frictional force is large, the de-curling drive control portion S3 fastens the sheet conveyance speed at the de-curling nip portion N3.

Note that the de-curling drive control portion S3 judges the large and small of the frictional force between the sheet P and the intermediate transfer belt 29 based on high and low of the coverage rate on the printing surface of the sheet P. The coverage rate on the printing surface of the sheet P is calculated by the image forming control portion S. The coverage rate calculated by the image forming control portion S is transmitted from the image forming control portion S to the de-curling drive control portion S3 as illustrated in FIG. 4. Based on the received coverage rate, the de-curling drive control portion S3 judges the magnitude of the frictional force between the sheet P and the intermediate transfer belt 29 and adjusts the sheet conveyance speed at the de-curling nip portion N3 corresponding to the magnitude of the judged frictional force.

Exemplary Embodiment

Next, a printing result of the printer 100 in which the rotational speed of the de-curling roller 80 and the de-curling counter roller 81 is controlled will be described as compared to a conventional printer in which the rotational drive of the de-curling unit 73 is not controlled. In the present embodiment, the printer 100 can feed an A3-size sheet P and its process speed is 214 mm/sec. Specifications of the pressure roller 42, the fixing sleeve 41 and the heater 30 in the fixing unit 72 and of the de-curling roller 80 and 81 of the de-curling unit 73 are as follows, respectively.

As for the pressure roller 42, a steel-made core metal of 17.5 mm in diameter was used as the core shaft portion 42*a*, and silicon rubber of 4.45 mm in thickness was used as the heat-resistant elastic layer 42*b*. The release layer 42*c* was formed by coating a PFA tube by 50 μm around the heat-resistant elastic layer 42*b*. The fixing sleeve 41 was formed into a cylindrical shape having an outer diameter of 24 mm. In the fixing sleeve 41, a SUS sleeve formed endlessly with thickness of 30 μm was used to keep a balance of strength as the base layer 41*a*. As the elastic layer 41*b*, silicon rubber of about 270 μm in thickness and of about $1.0\times10^{-3}$ cal/sec·cm·K of thermal conductivity was used in consideration that it is desirable to use a material having high thermal conductivity as much as possible in view of quick start. The PFA tube of about 20 μm in thickness was used as the releasing layer 41*c*. The releasing layer 41*c* was formed by coating the PFA tube on the outer circumferential surface of the silicon rubber serving as the elastic layer 41*b*. For the heater 30, aluminum nitride formed into a rectangular shape of 0.6 mm in thickness, 9 mm of width and 390 mm in longitudinal size was used as the substrate 30*a* to keep a balance of thermal capacity and strength. The resistance heating element layer 30*b* was molded to be about 10 μm in thickness, 310 mm in length and 5 mm in width. The insulating glass layer 30*c* was formed to be 80 μm in thickness. The sliding layer 30*d* was formed to be 6 μm in thickness.

In the de-curling roller 80, the core shaft portion 80*a* was a steel-made core metal having 10 mm diameter. Foamed silicon rubber of about 30 degree of Asker C hardness was formed to be the elastic layer 80*b* of 2 mm in thickness. The release layer 80*c* was formed by coating the PFA tube by 70 μm. As for the de-curling counter roller 81, the core shaft portion 81*a* was a steel-made core metal of 9.5 mm in diameter. The release layer 81*b* was formed by coating the PFA tube by 100 μm.

Still further, in the present embodiment, a range of the coverage rate in which the coverage rate is zero % or more and is 100% or less on the printing surface of the sheet P is divided into three stages of "high stage", "intermediate stage" and "low stage", respectively. Then, the sheet conveyance speed at the de-curling nip portion N3 defined in the de-curling unit 73 by the de-curling roller 80 and the de-curling counter roller 81 is set per stage of the coverage rate on the printing surface of the sheet P. That is, the sheet conveyance speed at the de-curling nip portion N3 is set into three stages of "high speed", "intermediate speed" and "low speed" respectively in order of speeds. Because the higher the stage of the coverage rate, the higher the coverage rate on the printing surface of the sheet P on the printing surface of the sheet P is and the smaller the frictional force generated between the sheet P and the intermediate transfer belt 29 is, the likelihood of occurrence of the slip between the sheet P and the intermediate transfer belt 29 increases. Then, in the case where the coverage rate is the "high stage", "intermediate stage" and "low stage", the sheet conveyance speed at the de-curling nip portion N3 is set to be "low speed", "intermediate speed" and "high speed", respectively.

Table 1 indicates a relationship between the coverage rate on the printing surface of the sheet P and the sheet conveyance speed at the de-curling nip portion N3 in the present embodiment. In Table 1, the process speed is abbreviated as "PS" in order to simplify the description of the table. Note that the abbreviation of the process speed as the "PS" is also applicable to Tables 3 and 4 described later.

TABLE 1

| COVERAGE RATE (%) | SHEET CONVEYANCE SPEED AT DE-CURLING NIP PORTION N3 |
|---|---|
| 60% OR LESS | PS + 3% |
| 60% OR MORE AND 80% OR LESS | PS + 2% |
| 80% OR MORE | PS + 1% |

As indicated in Table 1, as for the coverage rate on the printing surface of the sheet P of the present embodiment, the "high stage", "intermediate stage" and "low stage" of the coverage rate are defined respectively as "60% or less", "60% or more and 80% or less" and "80% or more". The sheet conveyance speed at the de-curling nip portion N3 is preferable to be set faster than the sheet conveyance speed at the fixing nip portion N2 to a degree not pulling the sheet P excessively as described above. Then, the "low speed", "intermediate speed" and "high speed" which are stages of the sheet conveyance speed at the de-curling nip portion N3 are set respectively as "PS (process speed)+1%", "PS+2%" and "PS+3%" in the present embodiment.

In other words, the rotational speed of the de-curling unit 73 is controlled to be PS+3% as a first rotational speed when the coverage rate is 60% or less as a first value, and the rotational speed of the de-curling unit 73 is controlled to be PS+2% as a second rotational speed when the coverage rate is 60% or more and 80% or less as a second value. Then, the rotational speed of the de-curling unit 73 is set such that the peripheral speed at the de-curling nip portion N3 is faster than the process speed which is the peripheral speed of the intermediate transfer belt 29 regardless of the coverage rate. While the lower the coverage rate, the faster the rotational speed of the de-curling unit 73 is, the rotational speed of the de-curling unit 73 may be set not only in the three stages like the present embodiment but may be set in two stages or in four stages or more.

Comparative Example

Meanwhile, the arrangement of a printer of a comparative example is the same with that of the exemplary embodiment except of that a sheet conveyance speed at a de-curling nip portion formed in a de-curling unit is constant regardless of a coverage rate on a printing surface of a sheet P. Note that the sheet conveyance speed at the de-curling nip portion in the comparative printer is set at the process speed+3% which is the same with the sheet conveyance speed (high speed) in the case where the coverage rate is 60% or less in which the coverage rate is the low stage in the exemplary embodiment.

Printing Result

Five each images in which the coverage rate on the printing surface of the sheet P is 5%, 20%, 50%, 75% and 100% are printed for each of the exemplary embodiment and the comparative example to confirm occurrences of image defects caused by the sheet conveyance speed at the de-curling nip portion. The same sheet, i.e., specifically an A3-size smooth sheet of 80 g/m$^2$ of grammage is fed and used in printing of either case of the exemplary embodiment and the comparative example. Table 2 indicates the confirmation result of the occurrences of the image defects on the sheet P after printing in the exemplary embodiment and in the comparative example. Note that marks "○" (balloon) and "x" (x mark) in Table 2 indicate the confirmation result of the occurrences of the image defects. Specifically, the mark "○" indicates that no image defect such as unevenness of gloss has occurred in all of the sheets on which images have been printed. The mark "x" indicates that an image defect such as unevenness of gloss has occurred on either sheet on which the image has been printed.

TABLE 2

| COVERAGE RATE (%) | EMBODIMENT | COMPARATIVE EXAMPLE |
|---|---|---|
| 5 | ○ | ○ |
| 20 | ○ | ○ |
| 50 | ○ | ○ |
| 75 | ○ | x |
| 100 | ○ | x |

As indicated in Table 2, no image defect such as unevenness of gloss was confirmed in all of the printed sheets in any cases where the coverage rate was 5%, 20%, 50%, 75% and 100% in the present embodiment. Meanwhile, in the comparative example, unevenness of gloss occurred and an image defect was confirmed in either printed sheet in the case where the coverage rate is 75% and 100%. Thus, it was confirmed to be able to reduce the occurrence of the image defect caused by the sheet conveyance speed at the de-curling nip portion N3 by adjusting the sheet conveyance speed at the de-curling nip portion N3 based on high and low of the coverage rate on the printing surface of the sheet P.

As described above, according to the present embodiment, it is possible to adjust the sheet conveyance speed at the de-curling nip portion N3 based on the coverage rate on the sheet P in the printer 100. As a result, even if the sheet conveyance speed drops at the secondary transfer nip portion N1, the sheet conveyance speed at the de-curling nip portion N3 is adjusted so as not to be excessively fast with respect to the sheet conveyance speed at the fixing nip portion N2 in the printer 100. Accordingly, it is possible to prevent the occurrence of excessive pulling of the sheet P otherwise caused by speed difference of the sheet conveyance speeds between the fixing nip portion N2 and the de-curling nip portion N3. As a result, it is possible to reduce the occurrence of the image defect even if the sheet conveyance speed drops at the transfer portion in the printer 100.

It is noted that while the content described above is what illustrating the case where the image forming apparatus of the present embodiment is the printer 100, the present disclosure is not limited to such case. For instance, the image forming apparatus may be a monochrome copier or a printer including one photosensitive drum as the image bearing member. Still further, the media sensor 77 needs not be necessarily provided in the printer 100 in the present embodiment. The loop sensor 120 in the loop detecting portion 16 is also not limited to the contact-type sensor and may be a non-contact type sensor such as an optical sensor capable of detecting the conveyance condition of the sheet P in non-contact. Note that the predetermined region set on the printing surface of the sheet P, which becomes a standard in calculating the coverage rate, needs not to be always the whole printing surface and may be a partial area of the printing surface offset from an outer edge by a predetermined length.

As the method of preventing the sheet P from being strongly pulled between the fixing nip portion N2 and the de-curling nip portion N3, it is also conceivable to change the rotational speed of the de-curling motor M3 corresponding to the detection result of the loop detecting portion 16, i.e., to a change of the rotational speed of the fixing motor M2. That is, in a case where the slip occurs at the secondary transfer nip portion N1 and the loop detecting portion 16 detects that the loop amount of the sheet P is reduced, the fixing drive control portion S2 delays the rotational speed of the fixing motor M2. Along with that, the de-curling drive control portion S3 delays the rotational speed of the de-curling motor M3. However, the subject of the present disclosure cannot be solved by such method. The reason thereof will be described.

At first, the loop detecting portion 16 only detects the loop amount between the secondary transfer nip portion N1 and the fixing nip portion N2 and cannot detect an actual conveyance speed of the sheet P. That is, even if the loop detecting portion 16 detects that the loop amount of the sheet P is reduced, it is unable to discriminate whether it is caused by the slip at the secondary transfer nip portion N1 or by the increased outer diameter of the pressure roller 42 due to high temperature. If it is caused by the slip at the secondary transfer nip portion N1, the conveyance speed of the sheet P becomes slower than the process speed at the fixing nip portion N2 if the rotational speed of the fixing motor M2 is delayed. Due to that, the rotational speed of the de-curling motor M3 also needs to be delayed. However, if it is caused by the increased outer diameter of the pressure roller 42 due to high temperature, the conveyance speed of the sheet P at the fixing nip portion N2 barely changes with respect to the process speed if the rotational speed of the fixing motor M2 is delayed. Due to that, if the rotational speed of the de-curling motor M3 is delayed, the sheet P is loosened unnecessarily between the fixing nip portion N2 and the de-curling nip portion N3. If the sheet P is loosened unnecessarily, it leads to a conveyance failure such as paper jam and eventually to the image detects. Due to the reason described above, it is necessary to adjust the sheet conveyance speed at the de-curling nip portion N3 based on the coverage rate on the printing surface of the sheet P in advance as described in the present embodiment.

Second Embodiment

Next, a second embodiment of the present disclosure will be described. An image forming apparatus of the second embodiment is different from the image forming apparatus of the first embodiment in the configuration of the control portion controlling the de-curling unit 73. That is, the first and second embodiments are different in terms of control functions of the de-curling unit 73 included in the de-curling drive control portion S3 (see FIG. 4) and of contents of control process made on the de-curling unit 73. More specifically, the second embodiment is different from the first embodiment in that the de-curling drive control portion S3 controls the sheet conveyance speed at the de-curling nip portion N3 in unit of a plurality of divided regions in a case where the sheet P includes the plurality of divided regions in the sheet conveyance direction. However, the image forming apparatus of the second embodiment is substantially the same with the image forming apparatus of the first embodiment other than the configuration of the de-curling drive control portion S3. Therefore, in the present embodiment, the substantially same components with those of the first embodiment will be denoted by the same reference numerals or illustrations thereof and an overlapped description will be omitted here.

In the printer 100 serving as an image forming apparatus of the second embodiment, in a case where the sheet P includes a plurality of regions divided in the sheet conveyance direction, the de-curling drive control portion S3 controls the sheet conveyance speed at the de-curling nip portion N3 based on the coverage rate per region of the plurality of divided regions. More specifically, the de-curling drive control portion S3 as illustrated in FIG. 4 is configured to be able to change the rotational speed of the de-curling motor M3 based on the coverage rate per region of the plurality of regions divided in the sheet conveyance direction. That is, the de-curling drive control portion S3 of the second embodiment has the function of controlling the rotational speed of the de-curling motor M3 in unit of the region of the plurality of regions divided in the sheet conveyance direction further with respect to the de-curling drive control portion S3 of the first embodiment.

Figure 7:
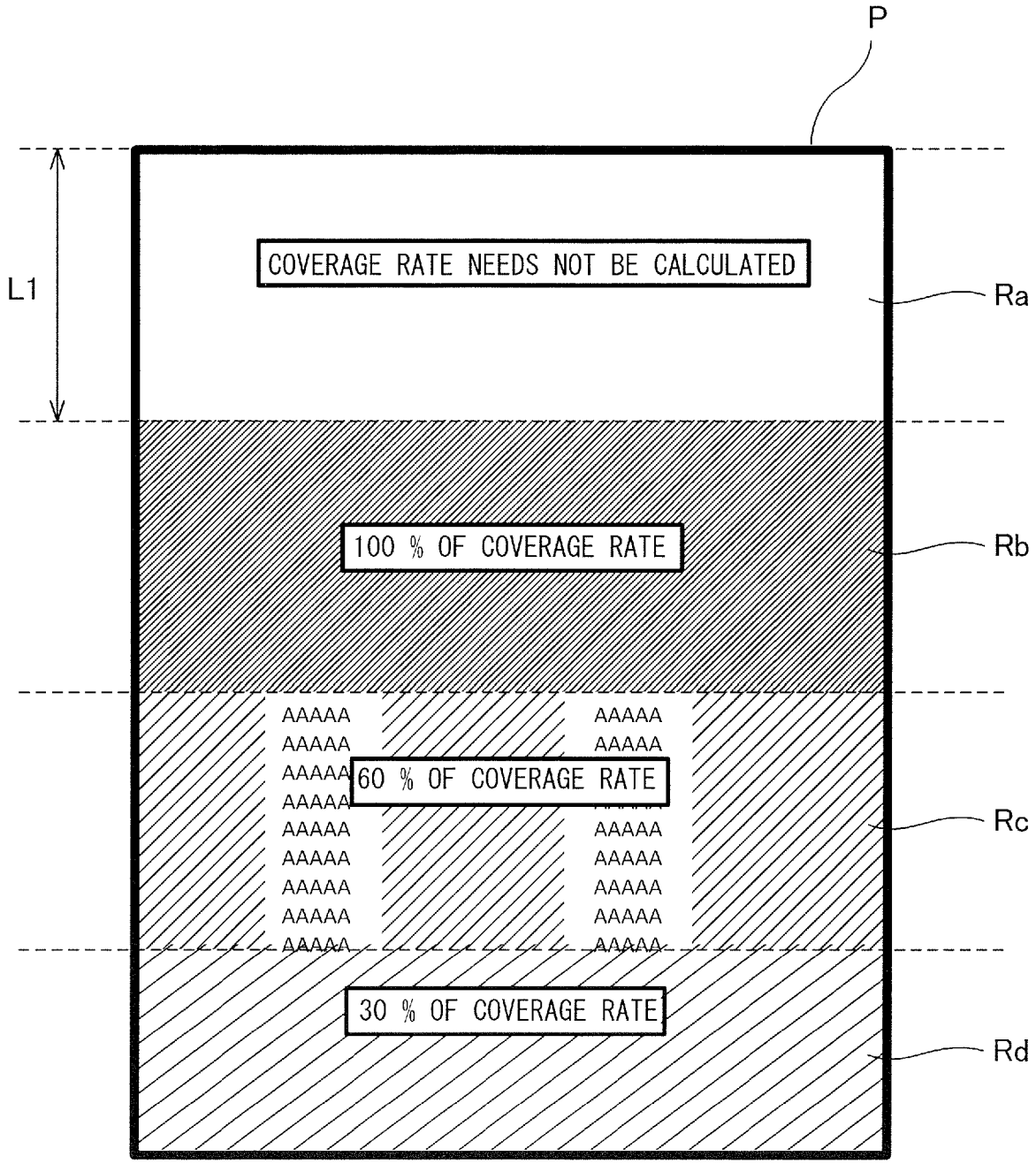
FIG. 7 illustrates calculation examples of coverage rates.

One exemplary control of the sheet conveyance speed at the de-curling nip portion N3 based on the coverage rate per each of plurality of regions set at different positions in the sheet conveyance direction will be described with reference to FIG. 4 described above and FIG. 7. Note that the sheet conveyance speed at the de-curling nip portion N3 is assumed to be controlled in the relationship as indicated in Table 1. In FIG. 7, an up and down direction, i.e., a vertical direction of the sheet surface, is the sheet conveyance direction and corresponds to the sheet conveyance direction D2. Four regions Ra through Rd divided in the sheet conveyance direction are set in the sheet P illustrated in FIG. 7. The coverage rates in the regions Rb, Rc and Rd are 100%, 60% and 30%, respectively. A length L1 in the sheet conveyance direction of the region Ra corresponds to a length between the secondary transfer nip portion N1 and the fixing nip portion N2 (see FIG. 4).

In a case where the sheet P illustrated in FIG. 7 is conveyed in the sheet conveyance direction D2 in FIG. 4, the sheet P passes through the secondary transfer nip portion N1, the fixing nip portion N2 and the de-curling nip portion N3 in order of the region Ra, the region Rb, the region Rc and the region Rd. During a period in which the region Ra positioned on the leading edge side in the sheet conveyance direction is conveyed through the secondary transfer nip portion N1, the leading edge of the sheet P does not reach the fixing nip portion N2 yet. Therefore, the sheet P is not pulled as described above between the secondary transfer nip portion N1 and the fixing nip portion N2. That is, no slip at the secondary transfer nip portion N1 occurs based on the stiffness of the sheet P across the secondary transfer nip portion N1 and the fixing nip portion N2 in the period until when the leading edge of the sheet P arrives at the fixing nip portion N2, and the control of the sheet conveyance speed at the de-curling nip portion N3 is not essential. Therefore, no calculation of the coverage rate of the region Ra is always required. The sheet conveyance speed is kept at a standard speed in the period until when the leading edge of the sheet P arrives at the fixing nip portion N2.

In the present embodiment, the length of the region Ra in the sheet conveyance direction D2 corresponds to the distance from the secondary transfer nip portion N1 to the fixing nip portion N2. That is, the region Rb as the predetermined region and as a first region and the region Rc as a second region are located at positions distant from the leading edge of the sheet more than the distance between the secondary transfer nip portion N1 and the fixing nip portion N2 in the sheet conveyance direction D2 respectively. The region Rc is set at a position different from the region Ra in the sheet conveyance direction D2 on the printing surface. Note that the first and second regions may be located at any of the regions Rb, Rc and Rd other than the region Ra.

Because the loop control is made during a period in which the regions Rb, Rc and Rd which are the regions succeeding the region Ra are conveyed through the secondary transfer nip portion N1, a slip may occur at the secondary transfer nip portion N1. Therefore, during the period in which the regions Rb, Rc and Rd are conveyed through the secondary transfer nip portion N1, the de-curling drive control portion S3 controls the sheet conveyance speed at the de-curling nip portion N3 when the respective regions are conveyed by the secondary transfer nip portion N1 based on the coverage rates in each region of the regions Rb, Rc and Rd. The coverage rates of the regions Rb, Rc and Rd illustrated in FIG. 7 are 100%, 60% and 30%, respectively. As the de-curling drive control portion S3 controls the rotational speed of the de-curling motor M3, the sheet conveyance speed at the de-curling nip portion N3 is adjusted to be PS (process speed)+1% during a period in which the region Rb is conveyed through the secondary transfer nip portion N1. During periods in which the regions Rc and Rd are conveyed through the secondary transfer nip portion N1, the sheet conveyance speed at the de-curling nip portion N3 is adjusted to be PS+2% and PS+1%, respectively.

That is, the de-curling drive control portion S3 controls the rotational speed of the de-curling unit 73 based on a first area ratio which is a ratio of an area in which a toner image is formed by the secondary transfer nip portion N1 within the region Rb when the region Rb is conveyed by the secondary transfer nip portion N1. The de-curling drive control portion S3 also controls the rotational speed of the de-curling unit 73 based on a second area ratio which is a ratio of an area in which the toner image is formed by the secondary transfer nip portion N1 within the region Rc when the region Rc is conveyed by the secondary transfer nip portion N1. These first and second area ratios are the coverage rates in the regions Rb and Rc.

As described above, according to the present embodiment, it is possible to adjust the sheet conveyance speed at the de-curling nip portion N3 in unit of the regions even in the case where the printing surface of the sheet P includes the plurality of regions divided in the sheet conveyance direction and the coverage rates are different in the respective regions as illustrated in FIG. 7. That is, even if the coverage rates of the sheet P is not uniform in the sheet conveyance direction, it is possible to adjust the sheet conveyance speed at the de-curling nip portion N3 to a speed conforming to each of the plurality of regions divided in the sheet conveyance direction.

Third Embodiment

Next, a third embodiment of the present disclosure will be described. An image forming apparatus of the third embodiment is different from the image forming apparatus of the first embodiment in the configuration of the control portion controlling the de-curling unit 73. That is, the third embodiment is different from the first embodiment in that the control function of the de-curling unit 73 of the de-curling drive control portion S3 (see FIG. 4) is different and a content of the control process made on the de-curling unit 73 is different. More specifically, the third embodiment is different from the first embodiment in that in a case where a second surface opposite to the printing surface, i.e., a first surface, is to be printed succeeding the first surface of the sheet P in duplex printing, a coverage rate of the second surface is also taken into account in controlling the rotational speed of the de-curling motor M3. However, the image forming apparatus of the third embodiment is substantially the same with the image forming apparatus of the first embodiment other than the configuration of the de-curling drive control portion S3. Therefore, in the present embodiment, the substantially same components with those of the first embodiment will be denoted by the same reference numerals or illustrations thereof and an overlapped description will be omitted here.

In the printer 100 as the image forming apparatus of the third embodiment, the sheet P is conveyed while taking also the coverage rate of the surface opposite from the printing surface (referred to as a "opposite printing surface" hereinafter) into account in the case of printing the second surface subsequently to the first surface of the sheet P in printing both surfaces. More specifically, the de-curling drive control portion S3 as illustrated in FIG. 4 is configured to be able to change the rotational speed of the de-curling motor M3 based on the coverage rate of the opposite printing surface together with the coverage rate of the printing surface. That is, the de-curling drive control portion S3 of the third embodiment has a function of controlling the rotation speed of the de-curling motor M3 also in printing the second surface of the sheet P in the duplex printing in addition to the function of the de-curling drive control portion S3 of the first embodiment.

Here, in order to distinguish the coverage rate of the first surface from the coverage rate of the second surface in printing the both surfaces, the coverage rate of the first surface will be called as a "first surface coverage rate" and the coverage rate of the second surface will be called as a "second surface coverage rate" hereinafter. That is, the first surface coverage rate serving as the first area ratio is an area ratio of an area in which a toner image is actually formed with respect to an area in which an image can be formed within a predetermined range set in the first surface as a first predetermined range. The second surface coverage rate serving as the second area ratio is an area ratio of an area in which a toner image is actually formed with respect to an area in which an image can be formed within a predetermined range set in the second surface as a second predetermined range.

The rotational speed of the de-curling motor M3 is changed based on the coverage rate of the first surface which is an opposite printing surface in printing the second surface of the sheet P in the duplex printing because a point that the coverage rate of the first surface affects the strength of the stiffness of the sheet P is taken into account. As described above, the slip occurring at the secondary transfer nip portion N1 is related with the strength of the stiffness of the sheet P. In a case where the coverage rate of the printed first surface is high, the stiffness of the sheet P is stronger than that before the toner image is fixed on the first surface, i.e., stronger than that in printing the first surface due to the toner image fixed on the first surface. Therefore, in a case where the sheet P is conveyed at the secondary transfer nip portion N1 in printing the second surface, a force greater than that in printing the first surface acts upward in the sheet conveyance direction at the secondary transfer nip portion N1. As a result, a slip is more liable to occur at the secondary transfer nip portion N1 than the case of printing the first surface due to the toner image transferred onto the second surface which is the printing surface of the sheet P together with the drop of the frictional force between the second surface of the sheet P and the intermediate transfer belt 29.

Therefore, according the third embodiment, the rotational speed of the de-curling motor M3 is controlled based not only on the second surface coverage rate but also on the first surface coverage rate in printing the second surface in order to effectively reduce the occurrence of the slip at the secondary transfer nip portion N1. That is, the de-curling drive control portion S3 controls the rotational speed of the de-curling unit 73 based on the first surface coverage rate serving as the first area ratio of the first region when the first region set on the first surface is conveyed with the toner image transferred by the secondary transfer nip portion N1.

Then, the de-curling drive control portion S3 controls the rotational speed of the de-curling unit 73 based on the second surface coverage rate and the first surface coverage rate when the third region of the sheet is conveyed with the toner image transferred by the secondary transfer nip portion N1. The second surface coverage rate serves as a third area ratio of the third region. The third region is set at a position corresponding to the first region in the sheet conveyance direction D2 on the second surface opposite to the first surface.

The image forming control portion S calculates the first surface coverage rate and the second surface coverage rate respectively in printing the second surface in the duplex printing. Table 3 indicates exemplary sheet conveyance speed at the de-curling unit 73 controlled based on the first surface coverage rate and the second surface coverage rate.

TABLE 3

| COVERAGE RATE (%) OF FIRST SURFACE | COVERAGE RATE (%) OF SECOND SURFACE | SHEET CONVEYANCE SPEED AT DE-CURLING UNIT 73 (IN PRINTING SECOND SURFACE) |
|---|---|---|
| 60% OR LESS | 60% OR LESS | PS + 3% |
| | MORE THAN 60% | PS + 1% |
| 60% OR MORE | 40% OR LESS | PS + 2% |
| | MORE THAN 40% AND 60% OR LESS | PS + 1% |
| | MORE THAN 60% | PS + 0% |

It is thus possible to suppress the influence of the image formed on the first surface by controlling the rotational speed of the de-curling motor M3 based not only on the second surface coverage rate but also on the first surface coverage rate in printing the second surface in the duplex printing. As described above, according to the present embodiment, it is possible to convey the sheet P more stably downstream in the sheet conveyance direction of the fixing portion in printing the second surface of the sheet P in the duplex printing. Note that the respective values of the first surface coverage rate, the second surface coverage rate and the sheet conveyance speed indicated in Table 3 are mere examples and are not restrictive. Those values are appropriately set by taking various conditions of the respective members used in the printer 100 into account.

Fourth Embodiment

Next, a fourth embodiment of the present disclosure will be described. An image forming apparatus of the fourth embodiment is different from the image forming apparatus of the first embodiment in the configuration of the control portion controlling the de-curling unit 73. That is, the fourth embodiment is different from the first embodiment in that the control function of the de-curling unit 73 of the de-curling drive control portion S3 (see FIG. 4) is different and a content of the control process made on the de-curling unit 73 is different. More specifically, the fourth embodiment is different from the first embodiment in that the de-curling drive control portion S3 considers sheet attribute including at least either one of surface nature and grammage of the sheet as a condition in controlling the rotational speed of the de-curling motor M3. However, the image forming apparatus of the fourth embodiment is substantially the same with the image forming apparatus of the first embodiment other than the configuration of the de-curling drive control portion S3. Therefore, in the present embodiment, the substantially same components with those of the first embodiment will be denoted by the same reference numerals or illustrations thereof and an overlapped description will be omitted here.

In the printer 100 serving as the image forming apparatus of the fourth embodiment, the de-curling drive control portion S3 as illustrated in FIG. 4 is configured to be able to change the rotational speed of the de-curling motor M3 based on the coverage rate and the sheet attribute. That is, the de-curling drive control portion S3 of the fourth embodiment has a function of controlling the rotational speed of the de-curling motor M3 by considering also the sheet attribute in addition to the coverage rate as compared to the de-curling drive control portion S3 of the first embodiment. Here, the sheet attribute is surface nature, grammage, name, size or the like of the sheet for example. Information of the sheet attribute is inputted to the image forming control portion S by receiving detection results from the media sensor 77 as illustrated in FIG. 1 or by receiving the information inputted by a user through a liquid crystal panel serving as an input interface not illustrated.

In a case where the media sensor 77 is provided in the printer 100 as illustrated in FIG. 1, it is possible to detect the sheet attribute of the sheet P based on detection results of the media sensor 77. As described above, the media sensor 77 includes the ultrasonic sensor and the optical sensor 79 in the present embodiment. It is possible to detect the grammage of the sheet P based on a peak value of the ultrasonic transmitted/received by the ultrasonic sensor. As for the grammage of the sheet P, the smaller the grammage, the greater the peak value of the ultrasonic received by the receiving portion 78*b*, as the ultrasonic transmits through the sheet P. Therefore, it is possible to detect the grammage of the sheet P by utilizing the peak value of the ultrasonic received by the receiving portion 78*b*, i.e., an attenuation ratio between the peak value of the ultrasonic transmitted from the transmitting portion 78*a* and the peak value of the ultrasonic received by the receiving portion 78*b*. It is also possible to detect the surface nature of the sheet P based on a rate of a shadow of a surface image obtained by imaging a reflection light from the sheet P in the optical sensor 79. It is possible to detect the surface nature of the sheet P by utilizing that the rougher the surface of the sheet P, the more the rate of the shadow of the image obtained by the optical sensor 79 is.

Note that there is also a case where the sheet attribute of the sheet P indicated by the detection result is different from that inputted by the user in the printer 100 capable of detecting the sheet attribute of the sheet P based on the detection result of the media sensor 77. In such case, it may be set in advance which one of the detection result of the media sensor 77 and the input of the user is prioritized for example. Even if the sheet attribute indicated by the detection result of the media sensor 77 differs from the sheet attribute inputted by the user, the prioritized sheet attribute is adequately inputted to the image forming control portion S by determining one to be prioritized in advance. Still further, as another example, it is also possible to display a message urging the user to determine one to be prioritized because the sheet attribute indicated by the detection result of the media sensor 77 differs from the sheet attribute inputted by the user on the liquid crystal panel serving as an output interface. In this case, either prioritized one of the sheet attribute indicated by the detection result of the media sensor 77 and the sheet attribute inputted by the user is inputted to the image forming control portion S.

In the present embodiment, at least either one of the surface nature and the grammage of the sheet is taken into account in conveying the sheet P. The rotational speed of the de-curling motor M3 is changed based also on the sheet attribute in printing the sheet P because the slip of the sheet P possibly occurring at the secondary transfer nip portion N1 is influenced by the surface nature and the grammage of the sheet P itself.

As for the influence of the surface nature of the sheet P, the smoother the surface roughness of the sheet P, the more the slip is liable to occur at the secondary transfer nip portion N1. Therefore, if the sheet P has a very smooth surface nature like a smooth sheet and a gloss sheet, the slip is liable to occur at the secondary transfer nip portion N1. Meanwhile, in a case where the sheet P has a rough surface nature like a rough sheet, no slip is liable to occur at the secondary transfer nip portion N1. Still further, in a case where the sheet P has a rough surface nature like a rough sheet, a frictional force between the sheet P and the intermediate transfer belt 29 becomes large by a certain degree even through a toner image. Therefore, in the case where the sheet P has the rough surface nature, no slip is liable to occur at the secondary transfer nip portion N1 even if an image having a high coverage rate such as 80% of coverage rate is formed on the sheet P. Then, in the present embodiment, in the case where the sheet P has the rough surface nature even if the coverage rate of the sheet P is high, the sheet conveyance speed at the de-curling nip portion N3 is set at a speed not delayed excessively. This arrangement is made to prevent the sheet P from being excessively loosened between the fixing nip portion N2 and the de-curling nip portion N3 which causes unstable conveyance of the sheet P and image defects and which otherwise occurs when the sheet conveyance speed at the de-curling nip portion N3 is excessively delayed.

As for the influence of the grammage of the sheet P, the greater the grammage, the stiffer the sheet is. As described above, the stronger the stiffness of the sheet P, the stronger the force of trying to eliminate a loop when the sheet P forms the loop is. As a result, the larger the grammage of the sheet P, the larger the action of the force of pressing the sheet P toward upstream in the sheet conveyance direction. Accordingly, even in a case where images having an equal coverage rate are to be printed, the likelihood of the occurrence of the slip at the secondary transfer nip portion N1 changes by magnitude of the grammage of the sheet P. Then, according to the present embodiment, in order to effectively reduce the occurrence of the slip at the secondary transfer nip portion N1, the sheet conveyance speed at the de-curling nip portion N3 is set low in a case where the grammage is large.

Note that it is possible to set the sheet conveyance speed at the de-curling nip portion N3 by considering not only either one of the surface nature and the grammage of the sheet P, but also both of the surface nature and grammage of the sheet P in the present embodiment. Specifically, the coverage rate, surface nature and grammage of the sheet P are divided into a plurality of stages and the sheet conveyance speed at the de-curling nip portion N3 is set corresponding to each divided stage. It is possible to set the sheet conveyance speed at the de-curling nip portion N3 adequately corresponding respectively to either stage of the coverage rate, surface nature and grammage of the sheet P by setting the sheet conveyance speed at the de-curling nip portion N3 as described above. Table 4 indicates an exemplary setting of the sheet conveyance speed at the de-curling nip portion N3 in the case where both the surface nature and the grammage are taken into consideration as the sheet attribute.

TABLE 4

| | GRAMMAGE ($g/m^2$) | 120 OR LESS | | | 120 OR MORE | | |
|---|---|---|---|---|---|---|---|
| | SURFACE NATURE | SMOOTH | NORMAL | ROUGH | SMOOTH | NORMAL | ROUGH |
| COVERAGE RATE (%) | 60% OR LESS | PS + 3% | PS + 3% | PS + 3% | PS + 2% | PS + 2% | PS + 3% |
| | MORE THAN 60% AND 80% OR LESS | PS + 2% | PS + 3% | PS + 3% | PS + 1% | PS + 2% | PS + 2% |
| | MORE THAN 80% | PS + 1% | PS + 2% | PS + 3% | PS + 0 | PS + 1% | PS + 1% |

Table 5 indicates specific sheet examples allocated to each frame of the grammage and the surface nature in Table 4.

TABLE 5

| GRAMMAGE ($g/m^2$) | SURFACE NATURE | SHEET EXAMPLES |
|---|---|---|
| 120 OR LESS | SMOOTH | CANON INC. GF-C081 |
| | NORMAL | Xerox Inc. Vitality Office Paper |
| | ROUGH | Neenah Paper Inc. Neenah Paper Capital Bond |
| MORE THAN 120 | SMOOTH | HP company HP Color Laser Brochure Paper, Glossy |
| | NORMAL | CANON INC. GF-C157 |
| | ROUGH | SpringHill INC. IndexDigital 1101b |

The exemplary setting of the sheet conveyance speed at the de-curling nip portion N3 indicated in Table 4 is what the coverage rate, surface nature and grammage of the sheet P are divided into three stages, three stages and two stages, respectively. In the example indicated in Table 4, there are 18 patterns in total of adoptable stages of the coverage rate, surface nature and grammage of the sheet P. The sheet conveyance speed at the de-curling nip portion N3 is set at either speed stage among four stages of PS (process speed)+3%, PS+2%, PS+1% and PS+0% per 18 patterns described above. As described above, the lower the coverage rate, the rougher the surface nature and the smaller the grammage, the harder the slip is considered to occur at the secondary transfer nip portion N1. The sheet conveyance speed at the de-curling nip portion N3 is set by considering this point in the examples indicated in Table 4. Specific exemplary setting of the sheet conveyance speed at the de-curling nip portion N3 will be described in (1) and (2) below.

(1) In Case where Grammage is 120 $g/m^2$ or Less

In a case where the coverage rate is 60% or less, the sheet conveyance speed at the de-curling nip portion N3 is set at PS+3% which is the fastest speed stage among the four stages even in any cases where the surface nature is smooth, normal and rough. In a case where the coverage rate is 60% or more and 80% or less and the surface nature is normal or rough and in a case where the coverage rate is 80% or more and the surface nature is rough, the sheet conveyance speed at the de-curling nip portion N3 is set at PS+3%. In a case where the coverage rate is 60% or more and 80% or less and the surface nature is smooth and in a case where the coverage rate is 80% or more and the surface nature is smooth, the sheet conveyance speed at the de-curling nip portion N3 is set at PS+2% which is the second speed stage among the four stages. In a case where the coverage rate is 80% or more and the surface nature is smooth, the sheet conveyance speed at the de-curling nip portion N3 is set at PS+1% which is the third speed stage among the four stages.

That is, in a case of conveying a sheet having a grammage of 120 g/m$^2$ or less as a first grammage, the de-curling drive control portion S3 controls the rotational speed of the de-curling unit 73 based on the first surface coverage rate when a first region set on the first surface is conveyed with the toner image transferred by the secondary transfer nip portion N1. The first surface coverage rate serving as the first area ratio is a ratio of an area in which a toner image is formed within the first region. Then, the de-curling drive control portion S3 controls the rotational speed of the de-curling unit 73 based on the second surface coverage rate and the first surface coverage rate when a third region of the sheet is conveyed with the toner image transferred by the secondary transfer nip portion N1. The second surface coverage rate serving as a third area ratio is a ratio of an area in which a toner image is formed within a third region. The third region is set at a position corresponding to the first region in the sheet conveyance direction D2 on the second surface opposite to the first surface.

(2) In Case where Grammage is 120 g/m$^2$ or More

In a case where the coverage rate is 60% or less and the surface nature is rough, the sheet conveyance speed at the de-curling nip portion N3 is set at PS+3%. In a case where the coverage rate is 60% or less and the surface nature is normal or rough and in a case where the coverage rate is 60% or more 80% or less and the surface nature is normal or rough, the sheet conveyance speed at the de-curling nip portion N3 is set at PS+2%. In a case where the coverage rate is 60% or more and 80% or less and the surface nature is smooth and in a case where the coverage rate is 80% or more and the surface nature is normal or rough, the sheet conveyance speed at the de-curling nip portion N3 is set at PS+1%. In a case where the coverage rate is 80% or more and the surface nature is smooth, the sheet conveyance speed at the de-curling nip portion N3 is set at PS+0% which is the slowest speed stage among the four stages.

In the present embodiment, the coverage rate, surface nature and grammage of the sheet P are divided respectively into the plurality of stages, and the sheet conveyance speed at the de-curling nip portion N3 is set corresponding to each divided stage. As a result, it is possible to effectively reduce the occurrence of the slip at the secondary transfer nip portion N1 for the sheet P having various coverage rate, surface nature and grammage.

Note that the examples indicated in Table 4 are one example of the sheet conveyance speed at the de-curling nip portion N3. That is, the examples indicated in Table 4 are applicable to a case corresponding to printing the first surface in simplex and duplex printings. In printing the second surface in the duplex printing, it is necessary to consider the stiffness of the sheet itself and the coverage rate of the first surface printed before the second surface. In a case where the stiffness of the sheet itself is strong, an influence of the image printed on the first surface is small. Accordingly, the de-curling drive control portion S3 may control the sheet conveyance speed at the de-curling nip portion N3 by judging whether the first surface coverage rate is taken into account corresponding to the stiffness of the sheet P itself. In a case where the grammage of the sheet P is larger than the first grammage of 120 g/m$^2$ or less and the stiffness of the sheet P itself is strong, the de-curling drive control portion S3 may control the sheet conveyance speed at the de-curling nip portion N3 based on the second surface coverage rate while ignoring the first surface coverage rate. That is, in a case of conveying a sheet having a second grammage greater than the first grammage, the de-curling drive control portion S3 controls the rotational speed of the de-curling unit 73 based on the second surface coverage rate as the third area ratio of the third region when the third region of the sheet is conveyed with the toner image transferred by the secondary transfer nip portion N1. Meanwhile, in a case where the sheet P has a second grammage which is smaller than the first grammage and the stiffness of the sheet P itself is weak because the grammage is smaller than the predetermined grammage, the first surface coverage rate is also taken into account together with the second surface coverage rate. That is, in a case where the stiffness of the sheet P itself is weak, the de-curling drive control portion S3 may control the sheet conveyance speed at the de-curling nip portion N3 based also on the first surface coverage rate together with the second surface coverage rate.

Note that while the media sensor 77 illustrated in FIG. 1 is provided between the registration roller pair 15 and the secondary transfer nip portion N1, the media sensor 77 may be provided upstream in the sheet conveyance direction of the secondary transfer nip portion N1. Still further, although the present embodiment has been described on the premise of the arrangement of detecting both attributes of surface nature and grammage of the sheet P, the arrangement may be what detects only either one attribute. The arrangement may be also what detects an attribute different from the surface nature and grammage of the sheet P. For instance, a contact-type sensor acquiring information related to a thickness of the sheet P by a piezoelectric element may be used.

Note that the present disclosure is not limited to the embodiments described above as it is and may be carried out in various forms other than the embodiments described above. Omission, replacement and modification of the present disclosure may be made within a scope not departing from the gist of the present disclosure. For instance, sizes, materials and shapes of component parts, their relative disposition or the like are applied to the present disclosure by adequately modifying corresponding to the construction and various conditions of the apparatus. The respective embodiments described above may be combined arbitrarily.

Still further, while the printer 100 including the de-curling unit 73 has been described as one exemplary image forming apparatus in the embodiments described above, the present disclosure is not limited to them. For instance, a sheet conveyance speed of various rotary member pairs disposed downstream in the sheet conveyance direction of the fixing unit 72 such as the discharge roller pair 64 may be controlled instead of the sheet conveyance speed at the de-curling unit 73. Still further, while the sheet conveyance speed at the de-curling unit 73 is controlled corresponding to the coverage rate of the printing surface in all of the embodiments described above, the sheet conveyance speed may be determined by taking image density into account in addition to the coverage rate.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-070177, filed Mar. 30, 2018, which is hereby incorporated by reference herein in its entirety.

What is claimed is:

1. An image forming apparatus comprising:

an image bearing member configured to bear a toner image;

a transfer portion configured to transfer the toner image borne on the image bearing member onto a sheet;

a fixing unit configured to fix the toner image which has been transferred onto the sheet by the transfer portion to the sheet;

a loop detector configured to detect an amount of a loop formed on the sheet at a position between the transfer portion and the fixing unit;

rotary members disposed downstream in a sheet conveyance direction of the fixing unit and configured to convey the sheet; and a controller configured to control a sheet conveyance speed of the fixing unit based on a detection result of the loop detector and control a rotational speed of the rotary members based on an area ratio which is a ratio of an area in which the toner image is formed by the transfer portion within a predetermined region set on a printing surface of the sheet onto which the toner image is transferred, wherein the predetermined region is located at a position distant from a leading edge of the sheet more than a distance between the transfer portion and the fixing unit in the sheet conveyance direction.

2. The image forming apparatus according to claim 1, wherein the controller controls the rotational speed of the rotary members to a first rotational speed in a case where the area ratio is a first value and controls the rotational speed of the rotary members to a second rotational speed which is slower than the first rotational speed in a case where the area ratio is a second value which is larger than the first value.

3. The image forming apparatus according to claim 2, wherein the image bearing member is configured to rotate and convey the toner image while bearing the toner image on an outer circumferential surface thereof, and wherein a peripheral speed of the rotary members that rotates with the first rotational speed or the second rotational speed is faster than a peripheral speed of the image bearing member.

4. The image forming apparatus according to claim 1, wherein the controller controls the fixing unit such that a sheet conveyance amount of the fixing unit approaches a sheet conveyance amount of the transfer portion after a leading edge of the sheet reaches the rotary members.

5. The image forming apparatus according to claim 1, wherein the controllers controls the rotational speed of the rotary members based on a sheet attribute at least including either one of surface nature and grammage of the sheet to be conveyed.

6. The image forming apparatus according to claim 1, wherein the rotary members correct a curl of the sheet on which the toner image has been fixed by the fixing unit.

7. The image forming apparatus according to claim 1, wherein the predetermined region is a first region, and wherein the controller controls the rotational speed of the rotary members based on a first area ratio which is a ratio of an area in which the toner image is formed by the transfer portion within the first region in a case where the first region of the sheet is conveyed by the transfer portion, and controls the rotational speed of the rotary members based on a second area ratio which is a ratio of an area in which the toner image is formed by the transfer portion within a second region which is set at a position different from the first region in a case where the second region is conveyed by the transfer portion.

8. The image forming apparatus according to claim 7, wherein the second region is located at a position distant from the leading edge of the sheet more than the distance between the transfer portion and the fixing unit in the sheet conveyance direction.

9. The image forming apparatus according to claim 1, wherein the predetermined region is a first region set on a first surface of the sheet, and wherein the controller controls the rotational speed of the rotary members based on a first area ratio which is a ratio of an area in which a toner image is formed by the transfer portion within the first region in a case where the first region of the sheet is conveyed with the toner image transferred by the transfer portion, and controls the rotational speed of the rotary members based on a third area ratio and the first area ratio in a case where a third region of the sheet is conveyed with a toner image transferred by the transfer portion, the third area ratio being a ratio of an area in which a toner image is formed by the transfer portion within the third region, the third region being set at a position corresponding to the first region in the sheet conveyance direction on a second surface opposite to the first surface.

10. The image forming apparatus according to claim 1, wherein the predetermined region is a first region set on a first surface of the sheet, wherein in a case of conveying a sheet having a first grammage, the controller controls the rotational speed of the rotary members based on a first area ratio which is a ratio of an area in which a toner image is formed by the transfer portion within the first region in a case where the first region of the sheet is conveyed with the toner image transferred by the transfer portion, and controls the rotational speed of the rotary members based on a third area ratio and the first area ratio in a case where a third region of the sheet is conveyed with a toner image transferred by the transfer portion, the third area ratio being a ratio of an area in which a toner image is formed by the transfer portion within the third region, the third region being set at a position corresponding to the first region in the sheet conveyance direction on a second surface opposite to the first surface, and wherein in a case of conveying a sheet having a second grammage greater than the first grammage, the controller controls the rotational speed of the rotary members based on the first area ratio in a case where the first region of the sheet is conveyed with the toner image transferred by the transfer portion, and controls the rotational speed of the rotary members based on the third area ratio in a case where the third region of the sheet is conveyed with the toner image transferred by the transfer portion.

11. The image forming apparatus according to claim 1, wherein the controller does not change the rotational speed of the rotary members based an area ratio which is a ratio of an area in which the toner image is formed by the transfer portion within a leading edge region set on a printing surface of the sheet onto which the toner image is transferred, and wherein the leading edge region is located at a position distant from the leading edge of the sheet less than the distance between the transfer portion and the fixing unit in the sheet conveyance direction.

* * * * *